United States Patent [19]

Swaneck

[11] Patent Number: 5,029,836

[45] Date of Patent: Jul. 9, 1991

[54] SHEET REGISTER CONTROL FOR PRINTING MACHINES

[76] Inventor: Edward H. Swaneck, Youngstown, Ohio 44512

[21] Appl. No.: 494,440

[22] Filed: Mar. 16, 1990

[51] Int. Cl.[5] ..... B65H 3/08; F16H 25/08

[52] U.S. Cl. ..... 271/107; 74/54; 414/737

[58] Field of Search ..... 74/53, 54; 271/94, 95, 271/103, 107, 108; 221/211; 414/737

[56] References Cited

U.S. PATENT DOCUMENTS

| | | | |
|---|---|---|---|
| 2,085,592 | 6/1937 | Koppe | 271/28 |
| 2,506,814 | 5/1950 | Sayre | 74/53 X |
| 2,689,730 | 10/1954 | Tebbs | 271/107 |
| 3,116,923 | 1/1964 | Günther | 74/54 X |
| 3,169,018 | 2/1965 | Loper | 271/27 |
| 3,342,395 | 10/1967 | Diepeveen | 74/53 X |
| 4,129,294 | 12/1978 | Marass | 271/107 X |
| 4,146,217 | 3/1979 | Barker | 271/108 |
| 4,248,417 | 2/1981 | Fujimoto | 271/107 X |
| 4,420,150 | 12/1983 | Umezawa | 271/108 X |
| 4,786,043 | 11/1988 | Jiruse et al. | 271/107 R |
| 4,901,821 | 2/1990 | Robbins | 74/53 R |
| 4,940,221 | 7/1990 | Wirz et al. | 271/108 X |

*Primary Examiner*—Allan D. Herrmann
*Assistant Examiner*—Julie Krolikowski
*Attorney, Agent, or Firm*—Harpman & Harpman; Harpman & Harpman

[57] ABSTRACT

An improved mechanism for feeding paper sheets from a stack by suction includes a manifold provided with a plurality of spaced sheet pick up devices carried by the manifold and in fluid communication therewith. The improved mechanism also includes motion orginating devices supporting said manifold for lifting the same and the suction mechanisms and a paper sheet held thereby from said stack and feeding it into the entry grippers or the printing roll feed mechanism of the printing machine. The motion originating devices are adjustable to pick up sheets at different locations relative to their leading edges while the printing machine is operating as contrasted with the heretofore necessary steps of shutting down the printing machine and making a mechanical adjustment in the feed linkage. The adjustment mechanism of the sheet register control extends to a point convenient to the printing machine operator.

12 Claims, 3 Drawing Sheets

SHEET REGISTER CONTROL FOR PRINTING MACHINES

BACKGROUND OF THE INVENTION

1. Technical Field

This invention relates to improvements in the feeding of sheet material such as paper sheets in an offset printing machine and more particularly to an adjustable sheet register controlling mechanism.

2. Description of the Prior Art

Paper sheet feed apparatus for offset printing machines and the like have been disclosed in the following U.S. Pat. Nos. 2,085,592, 3,169,018, and 4,146,217. These patents show sheet pick up devices which are relatively fixed and require shutting down the printing machine and making a mechanical adjustment in the feed linkage in order to accommodate paper sheets of differing weights, thickness, stiffness, and flexibility of the paper. This invention enables an operator to vary the registration of a plurality of vacuum shoes in the printing machine with a sheet of paper with respect to one end thereof whereby adjustment of the device enables the operator to position the vacuum shoes registry with the top sheet of paper at a desirable location with respect to the entry grippers or the printing roll feed.

SUMMARY OF THE INVENTION

The sheet register control for a printing machine disclosed herein is a relatively simple device which varies the registration of a plurality of vacuum shoes in the machine with a sheet of paper with respect to one end thereof whereby adjustment of the device enables an operator to position the vacuum shoes registry with a sheet of paper at a desirable location with respect to the entry grippers or the printing roll feed mechanism to which the sheet of paper is delivered. The device provides for the manual adjustment of the sheet register control from a point remote with respect thereto.

DESCRIPTION OF THE PREFERRED EMBODIMENT

Figure 1:
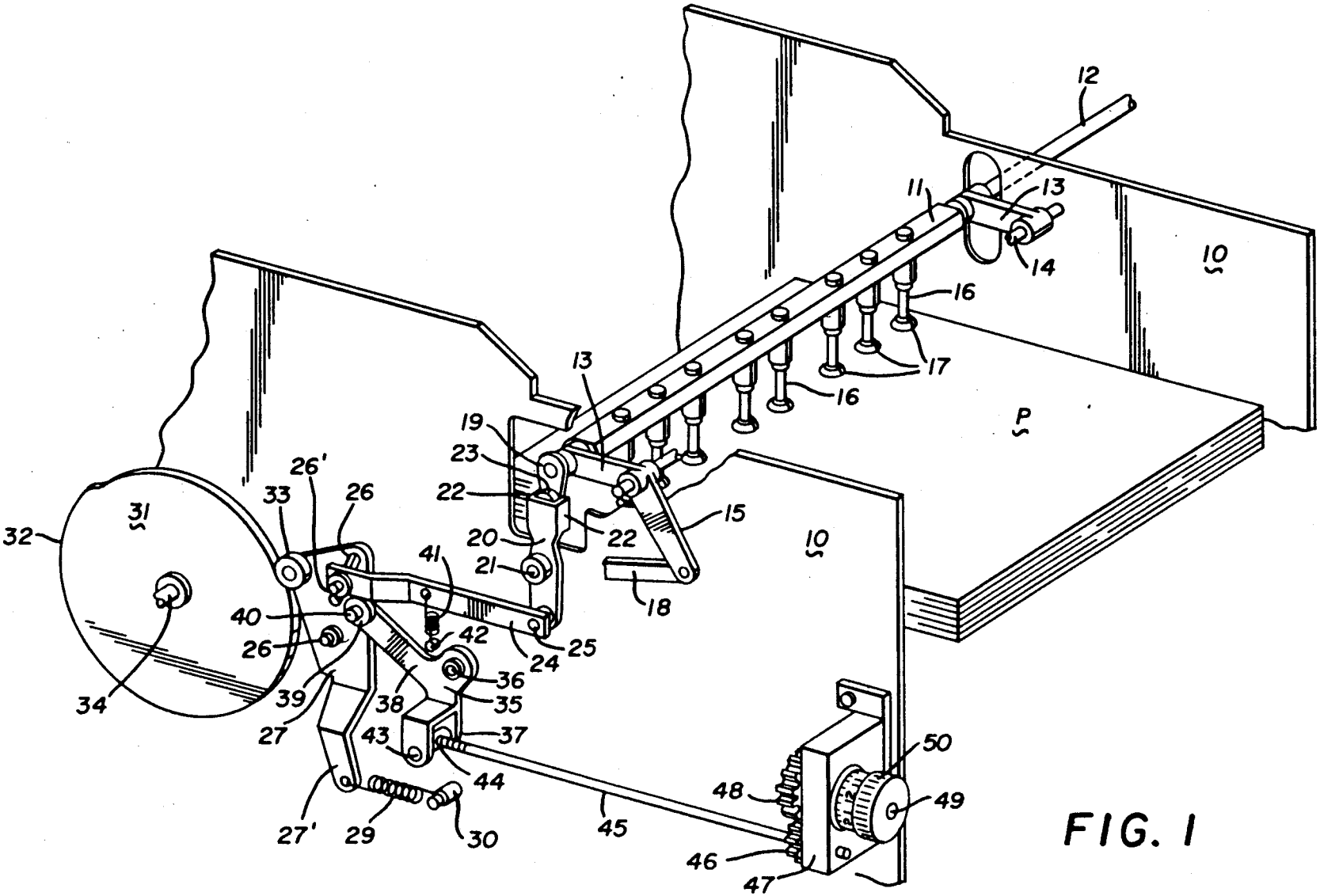
FIG. 1 is a perspective view showing the new sheet register control mechanism mounted in a well known type of printing press of the duplicator type.

In the form of the invention chosen for illustration and description, the sheet register control for printing machines of the duplicator type is best illustrated in FIG. 1 of the drawings wherein a pair of vertical panels 10 are illustrated as providing a space for a stack of paper P to be positioned therebetween and partially under a vacuum shaft 11 which communicates with a tube 12 which in turn communicates with a negative air pressure device so as to establish a partial vacuum in the vacuum shaft 11. The vacuum shaft 11 is movably positioned on the ends of a pair of spaced arms 13 which are affixed to a rod 14, the rod 14 being journaled at its opposite ends in openings in the panels 10. One of the arms 13 has an angular extension 15 which is formed in oppositely disposed relation to the vacuum shaft 11 so that downward motion applied to the annular extension 15 of the arm 13 acts to elevate the vacuum shaft 11.

A plurality of vacuum members 16 depend from the vacuum shaft 11 and comprise tubular members having annular, flexible, resilient, hollow shoes 17 on their lower ends. The plurality of vacuum members 16 are longitudinally spaced with respect to one another. The vacuum members 16 are of uniform length so that they will engage the upper surface of the upper sheet of paper on the stack P.

Still referring to FIG. 1 of the drawings, it will be seen that the angular extension 15 of the arm 13 is pivoted at its lower end to a link 18 by means of which reciprocating motion can be applied by a mechanism, not shown, whereby the vacuum shaft 11 is moved along a substantially vertical arcuate path responsive to motion imparted the link 18.

In order that the uppermost piece of paper on the stack of paper P can be elevated and moved toward the printing roll grippers of the printing machine, a lever 19 is affixed to one end of the movably positioned vacuum shaft 11 so that it can be partially revolved on its axis by motion imparted the lever 19.

Still referring to FIG. 1 of the drawings, it will be seen that a second lever 20 is pivoted midway between its ends by a pivot 21 to one of the panels 10 and that the uppermost end of the vertically disposed second lever 20 has a cross sectionally U-shape configuration formed by spaced flanges 22. A roller 23 on one end of the lever 19 is caged in the U-shaped end of the second lever 20 so that side to side motion imparted the second lever 20 will be imparted to the lever 19 and thus cause a partial rotating motion of the vacuum shaft 11. The vertical pocket formed by the U-shaped upper end of the second lever 20 is of a sufficient length to maintain engagement with the roller 23 when the vacuum shaft 11 is moved on the substantially vertical arcuate path hereinbefore described as a result of motion imparted the arm 13. A secondary link 24 is pivotally attached by a pivot 25 to the lower end of the second lever 20 and its opposite end carries a sidewardly projecting pin 26' which is slidably engaged in an elongated angularly positioned slot 26 formed in a body member 27 which is pivoted by a pivot 28 to one of the panels 10. The body member 27 is wider at its upper end than its lower end 27' which is offset outwardly. A spring 29 is attached to the lower end 27' of the body member 27 and engaged on a fastener 30 secured to one of the panels 10 so that the upper end of the body member 27 is biased toward a cam disc 31 having an enlarged cam surface 32 thereon. A cam engaging roller 33 is pivoted to the upper end of the body member 27 and is held in rolling engagement with the peripheral edge of the cam disc 31 which is rotatably positioned on a mounting pivot 34 secured to one of the panels 10.

It will occur to those skilled in the art that if desired a second cam disc, not shown, can be positioned on the pivot 34 and provided with a suitable cam surface on its peripheral edge so that reciprocal motion may be imparted either directly or indirectly to the link 18 heretofore referred to in order to impart motion to the vacuum shaft 11 to move it vertically on the substantially vertical arcuate path hereinbefore described.

It will also occur to those skilled in the art that the mechanism thus far described will impart lifting and forwarding motion to a sheet of paper on the stack of paper P and that the point of engagement of the plurality of vacuum members 16 and more particularly the annular flexible resilient hollow vacuum shoes 17 thereon will be relatively fixed with respect to the positioning of the stack of paper P in the printing machine.

As hereinbefore described, the present invention provides a novel mechanism for moving the plurality of vacuum members and their shoes 17 toward and away from the leading (left) end of the paper on the stack of paper P so that the desired point of registry may be readily altered to that desired.

Figure 2:
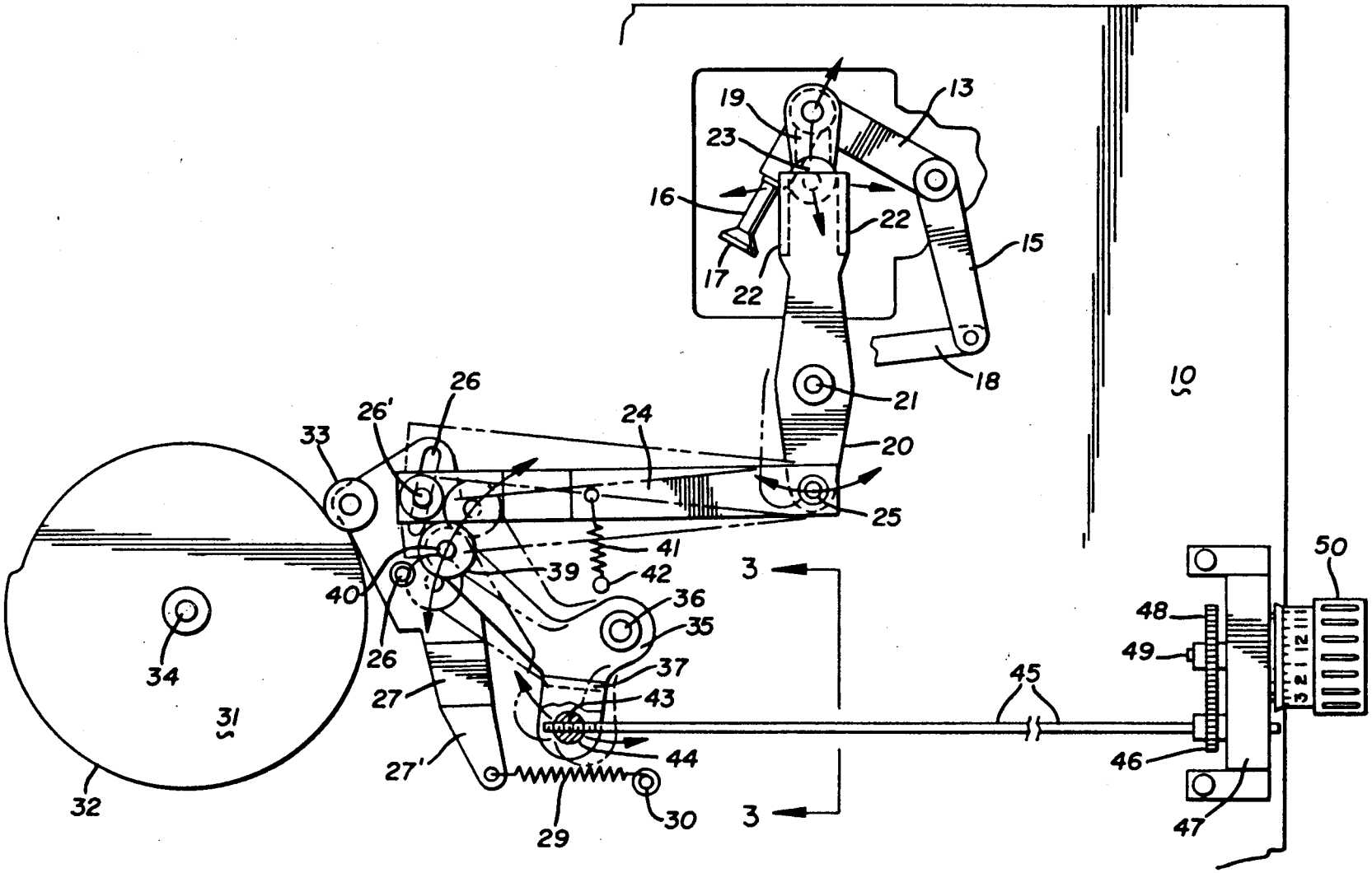
FIG. 2 is a side elevational view of the same mechanism with broken lines illustrating the alternate positions of the sheet register control.

By referring now to FIGS. 1 and 2 of the drawings, it will be seen that an adjustment arm 35 is pivoted by a pivot 36 to one of the panels 10. The adjustment arm 36 has a bifurcated lower end portion 37 and an upward angular extension 38 on which a roller 39 is positioned by means of a pivot pin 40. The roller 39 is engaged beneath the second link 24 adjacent the pivot pin 26' which as hereinbefore described is slidably mounted in the elongated slot 26 in the body member 27. A spring 41 is affixed to the second link 24 and to a fastener 42 on one of the panels 10 so as to urge the second link 24 into engagement with the roller 40.

The bifurcated lower end portion 37 of the adjustment arm 35 movably positions an enlarged pivot pin 43 which is provided with a transverse threaded bore 44 in which a threaded end of a control rod 45 is engaged. The opposite end of the control rod 45 is engaged in a gear 46 and a mounting bracket 47 secured to one of the panels 10. The gear 46 engages a second gear 48 which in turn is mounted on a shaft 49 extending through the mounting bracket 47 and terminating in an adjustment knob 50. The knob 50 is positioned on the exterior of the printing machine in a location convenient to the operator.

Figure 3:
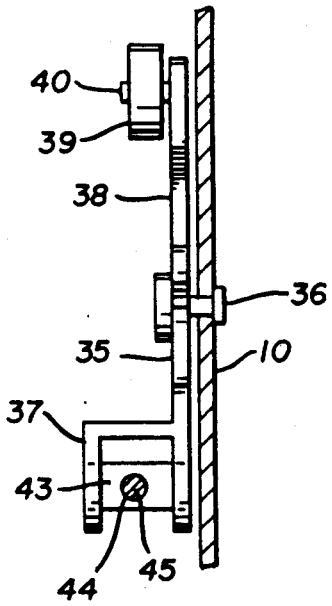
FIG. 3 is a cross sectional elevation on line 3—3 of FIG. 2.

FIG. 3 of the drawings illustrates the adjustment arm 35 and its respective parts in enlarged detail as taken on line 3—3 of FIG. 2.

By referring to FIG. 2, it will be seen that rotation of the adjustment knob 50 revolves the control rod 45 and its threaded end threadably engaged in the threaded transverse bore 44 in the enlarged pivot pin 43 which is positioned transversely of the bifurcated end 37 of the adjustment arm 35.

In FIG. 2 of the drawings, broken lines illustrate the alternate positions of the adjustment arm 35 obtained by rotating the adjustment knob 50 and it will be seen that clockwise rotation of the adjustment knob 50 will move the bifurcated end 37 of the adjustment arm 35 to the right and the upward extension 38 of the arm 35 and the roller 39 thereon downward so as to move the second link 24 downward as urged by the spring 41 so that the pin 26' slides downward to the left in the angular slot 26 in the body member 27 and thus moves the link 24 to the left in corresponding degree. This motion of the link 24 is imparted by the pivot 25 to the lower end of the second lever 20 which in turn moves the upper end thereof with the spaced flanges 22 caging the roller 23 on the lower end of the lever 19 to change the angle of the vacuum members 16 and shoes 17 which repositions their point of registry with the top sheet of paper on the stack of paper P in the printing machine.

It will be seen that this change of registry of the plurality of vacuum members 16 and their annular flexible resilient hollow shoes 17 which are in communication with a source of negative air pressure thus enables the point of registry of the vacuum members 16 and their shoes 17 to be changed while the printing machine is running as the motion originated by the cam 32 on the peripheral of the cam disc 31 is reduced or increased by the adjustment of the adjustment arm 35 and its resultant adjustment of the height of the second link 24 due to the pin 26' on the end of the link 24 engaging the angular slot 26 in the bottom member 27 by which the reciprocating motion is being transferred.

Figure 4:
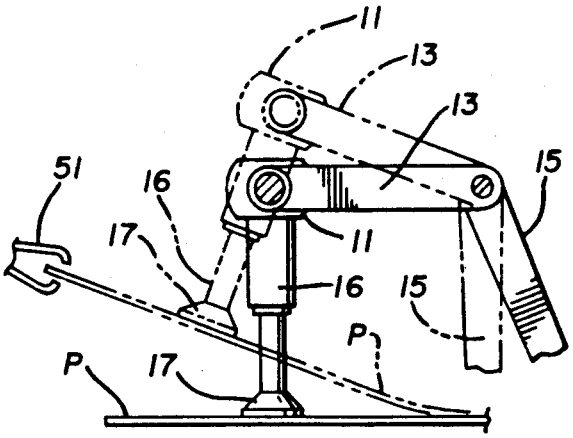
FIG. 4 is a side elevation of one of the vacuum shoes and actuating arms of FIG. 1.

In FIG. 4 of the drawings, a portion of FIG. 2 has been illustrated as it appears behind the aforesaid mechanism by which the vacuum shaft 11 is elevated and partially rotated. A sheet of paper on the stack P is shown in broken lines as having been lifted by the vacuum members 26 and their shoes 17 and moved forwardly, to the left, into the grippers 51 of the printing machine.

It will thus be seen that the present invention which essentially comprises the adjustment arm 35 with its enlarged pivot pin 43 and the transverse bore 44 therein receiving the control rod 45 and the roller 39 on the upper angular extension 38 of the adjustment arm 35 engaged on the second link 24 for movement of the same relative to the angular slot 26 in the body member 27 makes it possible for a printing press operator to vary the timing by means of picking up a sheet to be printed and feeding it to the entry grippers or the printing roll feed mechanism of a printing machine of the duplicator type without shutting down the machine to make a mechanical adjustment in the feed linkage. This adjustment capability while the machine is operating eliminates the former down time and difficult mechanical adjustment to the working parts that was heretofore necessary.

Having thus described my invention, what I claim is:

1. An improvement in a printing machine of the duplicator type having a vacuum shaft with vacuum members and shoes depending therefrom, means for moving said vacuum shaft on a generally upright arcuate path and means for imparting simultaneous partial rotation thereto about its axis, the improvement comprising; a cam, a body member engaging said cam for generating reciprocal motion responsive to movement of said cam, an angular slot in said body member, a link, a pin on said link engaging said angular slot in said body member and levers connecting said link to said vacuum shaft, means for moving said pin and link along said angular slot whereby the pin and link move toward and away from said cam so as to change the length of travel of said link relative to said body member and said levers connected to said vacuum shaft.

2. The improvement in a printing machine of claim 1 wherein said means for moving said pin and link comprise an adjustment arm having a portion engaging said link adjacent said pin and a device for moving said adjustment arm toward and away from said link.

3. The improvement in a printing machine of claim 1 wherein spring means urge said body member and roller thereon toward said cam disc.

4. The improvement in a printing machine set forth in claim 2 wherein spring means urge said link toward said adjustment arm.

5. The improvement in a printing machine set forth in claim 1 wherein said cam is a cam disc, and a roller on said body member engages said cam disc.

6. The improvement in a printing machine set forth in claim 2 wherein said device comprises a bifurcated portion on said adjustment arm, an enlarged pin in said bifurcated portion having a transverse threaded bore, a rod having a threaded end engaged in said threaded bore, said rod positioned in an opening in a fixed bracket, a knob on said rod adjacent said bracket for rotating the same so as to move said adjustment arm.

7. An improvement in a printing machine of the duplicator type having a vacuum shaft with vacuum members and shoes depending therefrom, means for moving said vacuum shaft on a generally upright arcuate path and means for imparting simultaneous partial rotation thereto about its axis, the improvement comprising; said means for imparting partial rotation about its axis to said vacuum shaft comprising; a cam, a body member engaging said cam for generating reciprocal motion responsive to movement of said cam, an angular slot in said body member, a link, a pin on said link engaging said angular slot in said body member and levers connecting said link to said vacuum shaft, a first one of said levers engaged on one end of said vacuum shaft, a roller on said first lever, a second lever pivoted midway between its upper and lower ends to said printing machine and disposed vertically, spaced right angular flanges on said upper end of said second lever caging said roller on said first lever, said link pivotally connected to said lower end of said second lever, means for moving said pin and link along said angular slot whereby the pin and link move toward and away from said cam so as to change the length of travel of said link relative to said body member and said first and second levers connected to said vacuum shaft.

8. The improvement in a printing machine of claim 7 wherein said means for moving said pin and link comprise an adjustment arm having a portion engaging said link adjacent said pin and a device for moving said adjustment arm toward and away from said link.

9. The improvement in a printing machine set forth in claim 7 wherein spring means urge said link toward said adjustment arm.

10. The improvement in a printing machine set forth in claim 7 wherein said cam is a cam disc, and a roller on said body member engages said cam disc.

11. The improvement in a printing machine of claim 7 wherein spring means urge said body member and roller thereon toward said cam disc.

12. The improvement in a printing machine set forth in claim 8 wherein said device comprises a bifurcated portion on said adjustment arm, an enlarged pin in said bifurcated portion having a transverse threaded bore, a rod having a threaded end engaged in said threaded bore, said rod positioned in an opening in a fixed bracket, a knob on said rod adjacent said bracket for rotating the same so as to move said adjustment arm.

* * * * *